US005697137A

United States Patent [19]

Frearson et al.

[11] Patent Number: 5,697,137

[45] Date of Patent: Dec. 16, 1997

[54] PNEUMATICALLY POWERED FASTENER INSTALLATION TOOL

[75] Inventors: William Harvey Frearson, Letchworth; Terence Gilbert, Welwyn Garden City; John William Saxon, Sawtry, all of United Kingdom

[73] Assignee: Avdel Textron Limited, Welwyn Garden City, United Kingdom

[21] Appl. No.: 656,049

[22] Filed: May 31, 1996

[30] Foreign Application Priority Data

Jun. 2, 1995 [GB] United Kingdom ..... 9511168

[51] Int. Cl.[6] ..... B21J 15/22

[52] U.S. Cl. ..... 29/243.525; 29/243.521

[58] Field of Search ..... 29/243.521, 243.523, 29/243.524, 243.525

[56] References Cited

U.S. PATENT DOCUMENTS

| | | | |
|---|---|---|---|
| 4,648,258 | 3/1987 | Frearson . | |
| 4,704,888 | 11/1987 | Frearson . | |
| 4,770,023 | 9/1988 | Schwab | 29/243.523 |
| 4,804,023 | 2/1989 | Frearson . | |
| 4,815,310 | 3/1989 | Summerlin et al. . | |
| 4,866,972 | 9/1989 | Schwab | 29/243.523 |
| 4,924,691 | 5/1990 | Summerlin et al. | 29/243.523 |
| 5,072,501 | 12/1991 | Vincenzo | 29/243.523 |
| 5,500,990 | 3/1996 | Wihan | 29/243.525 |

FOREIGN PATENT DOCUMENTS

| | | |
|---|---|---|
| 1 471 824 | 4/1977 | United Kingdom . |
| 2 116 102 | 9/1983 | United Kingdom . |
| 2 130 514 | 6/1984 | United Kingdom . |
| WO 87/01630 | 3/1987 | WIPO . |

*Primary Examiner*—David Jones

*Attorney, Agent, or Firm*—Oblon, Spivak, McClelland, Maier & Neustadt, P.C.

[57] ABSTRACT

In a fastener installation tool which is pneumatically powered to instal a blind rivet or bolt by a relative pulling action, a pneumatic/hydraulic intensifier (12, 13) is included to actuate hydraulically the pulling stroke of a head piston (22) which provides the relative pulling action. It is desirable to design such tools so that they have increased levels of safety for the persons using and operating them. In such a tool, there is provided a safety device including a valve for disabling the supply of air to one side of a pneumatic piston and cylinder device (15) and a push-rod (51) operative connected to the valve and extending along the inside of the air supply conduit The push rod normally contacts the displaceable end (43) of the cylinder when the displaceable end is in its safe position so as to operate the valve to allow the supply of air to the pneumatic chamber. The push-rod is movable, when the displaceable end of the cylinder is displaced from its safe position, to operate the valve so as to disable the supply of air under pressure to the cylinder on the aforesaid side of the piston.

7 Claims, 5 Drawing Sheets

PNEUMATICALLY POWERED FASTENER INSTALLATION TOOL

The invention relates to fastener installation tools. It is particularly, but not exclusively, applicable to fastener installation tools of the type which are pneumatically powered to instal a blind rivet or bolt by a relative pulling action, and may incorporate a pneumatic/hydraulic intensifier to actuate hydraulically the pulling stroke of a head piston which provides the relative pulling action.

Such fastener installation tools have been well-known for many years, and examples are commercially available under the designation AVDEL (Registered Trademark) Series 724, 734, 7385, 749, and 764, as well as from other manufacturers.

More recently there have been requirements for such tools to be lighter in weight, less costly to manufacture and easier to service. One result of this is the increased use of major structural components of synthetic plastics material instead of metal. It is also helpful to be able to build equipment to wider tolerances of dimensions and angles.

Whilst the cost and weight of components made of plastics material are less than those of similar components made of metal, their strength is also less. Simplified methods of construction, leading to simpler assembly and servicing, may also provide less security against improper or incomplete re-assembly.

At the same time there has also been introduced a requirement that industrial equipment, including such tools, has increased levels of safety for the person using and operating it.

The present invention is aimed at overcoming such problems.

The invention provides a pneumatically powered fastener installation tool, including a pneumatic piston and cylinder device having an air supply conduit for supplying air under pressure to the cylinder on one side of the piston which air supply conduit extends from the end of the cylinder on the other side of the piston and through the piston to the aforesaid one side; the end of the cylinder on the aforesaid one side of being displaceable from a safe position in which it is safely secured to the remainder of the cylinder;

and a safety device comprising:

valve means for disabling the supply of air to the aforesaid one side of the piston;

and a push-rod operative connected to the valve means and extending along the inside of the air supply conduit;

the push-rod normally contacting the displaceable end of the cylinder when the displaceable end is in its safe position so as to operate the valve means to allow the supply of air to the pneumatic chamber, and the push-rod being movable, when the displaceable end of the cylinder is displaced from its safe position, to operate the valve means so as to disable the supply of air under pressure to the cylinder on the aforesaid side of the piston.

In a preferred embodiment of the invention the displaceable end is secured in its safe position by securing means comprising a screw-threaded arrangement, in which the safety device is arranged to disable the supply of air as aforesaid when the engagement of the screw-threaded arrangement has been reduced to a predetermined number of screw-threads. Preferably the displaceable end is secured to the remainder of the chamber by securing means which is separate from the displaceable end.

Preferably the valve means disables the supply of air to the cylinder by positively shutting off the supply of air.

Preferably the valve means comprises a valve member co-operating with a valve seat, the valve member being operatively connected to the push-rod. Preferably the valve means is urged into the disabling position by the action of the air supply on it.

When the tool is at least partially actuated by air under pressure, preferably the safety device is arranged to vent the air under pressure when the collection means is not connected to the tool.

When the tool head is returned by air under pressure, preferably the safety device is arranged to vent this air when the collection means is not connected to the tool, thereby to prevent return of the head piston and thus further operation of the tool.

Preferably the safety device comprises a venting valve which is held closed by the collection means when the latter is connected to the tool, and which is opened to allow the venting of air under pressure when the collection means is not so connected.

The collection means may comprise a collection vessel into which, when it is connected to the tool, broken off fastener parts are ejected by the tool.

A specific embodiment of the invention will now be described by way of example and with reference to the accompanying drawings, in which.

Figure 1:
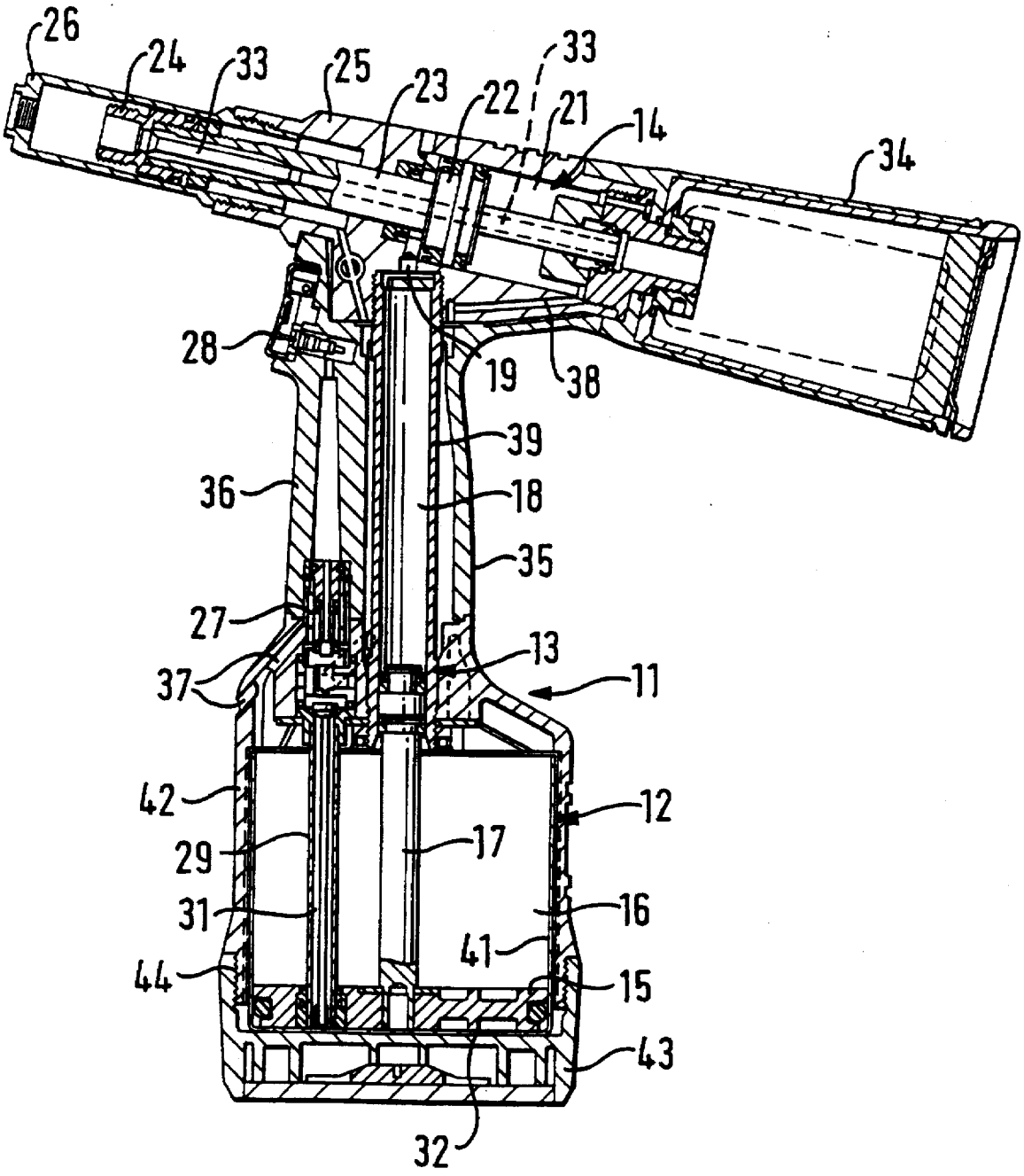
FIG. 1 is a longitudinal section through a pneumatic/hydraulic fastener installation tool.

The fastener installation tool 11 illustrated in FIG. 1 is pneumatically powered and is intended to install blind breakstem rivets. It comprises a pneumatic piston and cylinder device 12 coupled to a drive a hydraulic master piston and cylinder device 13 so as to act as a pneumatic/hydraulic intensifier; and a hydraulic slave piston and cylinder device 14. The pneumatic device 12 comprises a pneumatic piston 15 reciprocable in a pneumatic cylinder 16. The pneumatic piston 15 is secured to a rod 17 which forms the piston of the hydraulic master device 13, reciprocable in a hydraulic master cylinder 18. The cylinder 18 above the piston rod 17 is filled with hydraulic fluid and communicates via a bore 19 with the hydraulic slave cylinder 21 on the front side of the hydraulic slave piston 22. The slave piston 22 is secured to a drawbar 23, to the front end 24 of which is secured a jaw mechanism (not shown) for gripping the stem of a rivet. The head cylinder 21 is provided within a metal head housing 25, to the front end 26 is secured an annular anvil (not shown) to support the shell of a rivet.

Compressed air is supplied to the tool by means of a hose and coupling (not shown). Admission of air to the pneumatic part 12 of the tool is controlled by an air valve 27 which is actuated by a trigger 28. When the trigger 28 is pressed, the air valve 27 opens and admits compressed air to the space in the pneumatic cylinder 16 on the side of the piston 15 which is remote from the air valve 27, by means of an air supply conduit 29 in the form of a rigid tube which passes through the piston 15, the open end 31 of the tube being closely adjacent the bottom end wall 32 of the pneumatic cylinder 32 on the side of the piston 15 remote from the air valve 27. When the trigger 28 is depressed, the valve 27 admits air under pressure, down the tube 29, to the cylinder 16 beneath the piston 15. The piston 15 rises, forcing the hydraulic piston rod 17 up into the hydraulic master cylinder 18. The action of the hydraulic fluid forces the slave head piston 22 rearwards, thus retracting the drawbar 23 and jaws with respect to the head assembly 25 and anvil, thus installing the blind rivet in the well-known way.

The drawbar 23 and head piston 22 have running through them a central bore 33 for disposal of the broken-off rivet stem from each rivet installation. Broken off rivet stems are propelled rearwardly by an air stream along the bore.

Collection means is attached to housing of the rear of the head housing 25 in the form of a collector vessel 34 to retain the stems.

When the trigger 28 is released, the air valve 27 moves back to its original position. Air supply to the bottom of the pneumatic cylinder 16 is shut off, whilst the space in the cylinder above the piston 15 is connected to exhaust via a bore 37. The pistons 22 and 15 are returned to their original position by means of air at supply line pressure fed to the rear side of the head piston 22 by a conduit 38, the return of hydraulic fluid pushing the hydraulic piston 17 down again.

The riveting tool of this example is conventional in its layout. The pneumatic part 12 is arranged vertically, with the larger diameter pneumatic cylinder 16 at the bottom, to provide a relatively wide base on which the tool can be stood on a work bench or other horizontal surface when not in use. A hand grip 35 surrounds the narrower diameter hydraulic master cylinder 18, the trigger 28 being positioned at the upper end of the grip. The head piston and cylinder 14 entered across the top of the grip, so that the front end 26 of the head assembly protrudes and can access a workpiece in which a rivet is to be installed.

The general construction and operation of this example tool, as thus far described, are well known and understood.

In this example, the head assembly 25 is a metal casting, but substantial use of synthetic plastics materials (e.g. glass-fibre filled nylon) is made use of elsewhere to provide an outer casing within which working parts of metal are contained. Thus, the hand grip 35 is provided by the outside of an intermediate body member 36 of plastics material. The hydraulic master cylinder 18 is provided by a steel cylinder tube 39 contained inside the body member 36, and secured at its upper end the head assembly 25.

The pneumatic cylinder 16 is provided by an aluminium alloy cup-shaped liner 41, open at its top, the bottom providing the bottom end wall 32 of the cylinder. The liner 41 is contained inside a lower body member 42 of plastics material, secured at its upper end to the lower end of the intermediate body member 36.

The base of the tool is provided by a base member 43, also of plastics material. The base member 43 is in screw threaded engagement with the bottom end of the lower body member 42.

Figure 2B:
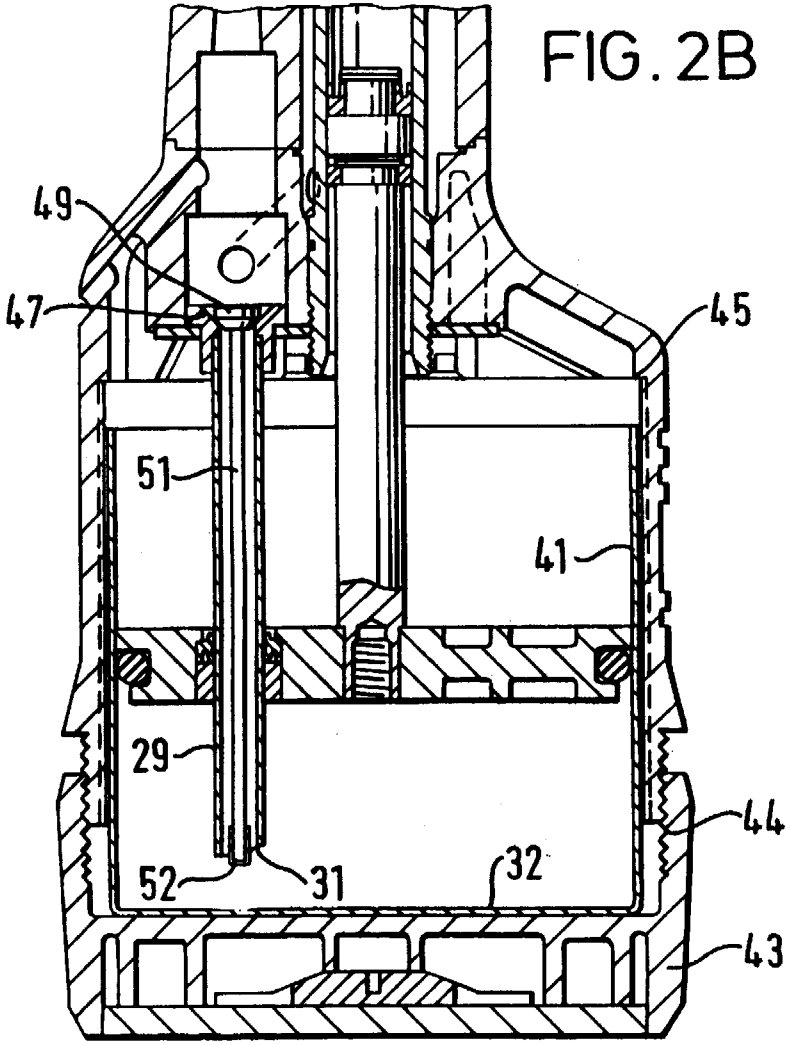
FIGS. 2A and 2B are longitudinal sections through the pneumatic piston and cylinder part of the tool, showing the operation of a safety device associated with the bottom end of the pneumatic cylinder.
Figure 2A:
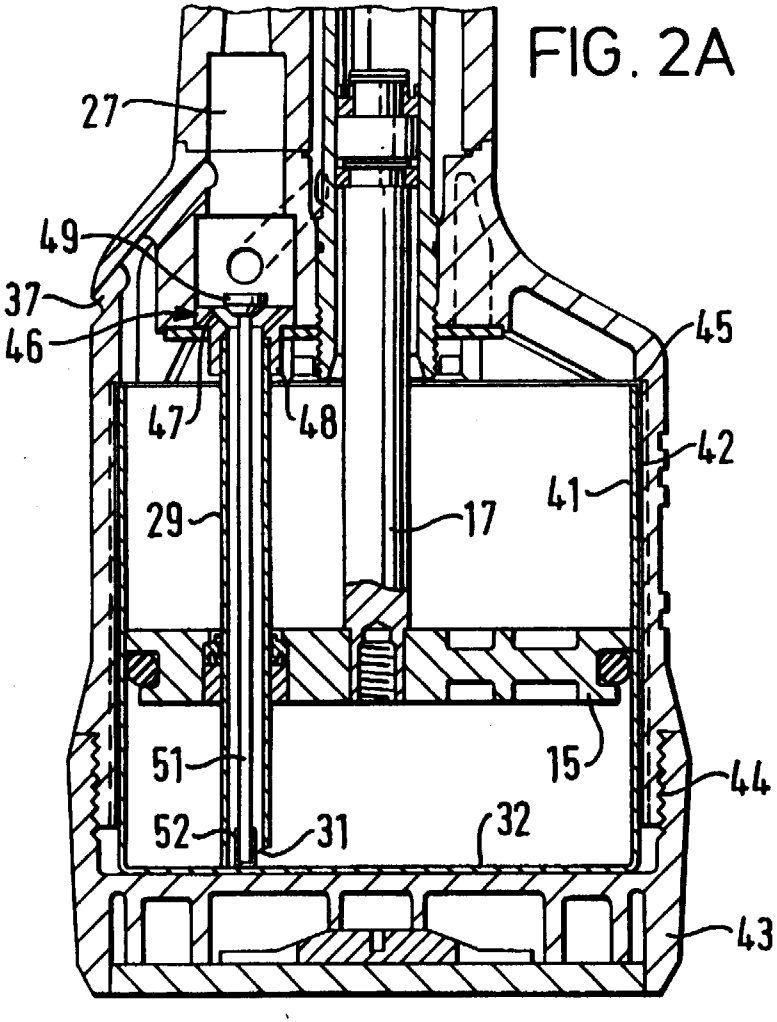

Referring now to FIGS. 2A and 2B, the base member 43 is in the form of a cap, which is in threaded engagement at 44 with the lower end of the lower body member 42. FIG. 2A shows the position where the base 43 is in maximum threaded engagement with (i.e. fully screwed home onto) the lower body member 42. In this position, it locks the liner cup 41 tight against an annular shoulder 45 at the upper end of the inside of the body member 42. The number of turns of screwthread by which base member is thus in threaded engagement with the body member 42 is known to give sufficient strength to the screw-threaded joint thereby formed to safely resist the downwards force on the base member exerted by the bottom wall 31 of the liner cup 41 due to the air pressure within the latter when the tool is in use.

If the base member 43 becomes unscrewed from the body member 42 (for example, due to vibration), or if the base member 43 is only partially screwed back onto the body member 42 (for example, after removal of the base member during servicing of the tool), it could be that the number of turns of engagement of the screw-threaded joint is so few that the strength of joint thereby produced is insufficient to safely retain the base member 43 on the body member 42 when the tool is in use. The minimum number of turns of engagement required to ensure a safe joint can be determined. Since relative rotation of the base member 43 produces axial movement of the base member, and therefore of the cup liner 41 (which is pressed into contact with the base member 43 by the air pressure within the liner), with respect to the body member 42, a limiting lower most-position or limiting safe position, of the end wall 32 of the liner 41, can be determined.

The tool of the present example is provided with a safety device which detects when the liner bottom wall 32 is lower than its limiting safe position. This is provided by a safety shut-off valve 46 mounted within the upper end of the lower body member 42, and positioned just above the upper end of the liner 41. The safety valve 46 comprises a valve seat 47 in a block 48 secured to and in communication with the outlet of the main air valve 27, and a valve member 49 which mates with the seat 47. The valve member 49 is of synthetic plastics material and is secured to the upper end of a push-rod 51 which extends downwardly through the air supply tube 29. The bottom of the push-rod 51 includes a soft or resilient buffer pad 52 which can contact the end wall 32 of the liner.

The length of the push-rod 51 is sufficient that when the base member is fully screwed home onto the body member 42, as illustrated in FIG. 2A, the bottom end wall 32 of the liner 41 contacts the button of the push-rod 51 and displaces it upwards to raise the valve member 49 away from the valve seat 47. If the base member becomes progressively unscrewed from the body member 42, the liner 41 moves downwards in the lower body member 42, due to the air pressure within it, and allows the valve member 49 to approach the valve seat 47, under the urging of air flowing past the valve member.

The length of the push-rod 51 is determined so that, by the time the base member 43 is sufficiently unscrewed that the liner bottom wall 32 reaches the corresponding limiting safe position, the valve member 49 contacts the valve seat 47 so that the safety valve 46 closes, and shuts off the supply of air to the pneumatic cylinder. Thus the tool will not operate. FIG. 2B shows the position where the base member 43 has been unscrewed beyond the safe limit, so that the bottom wall 32 has lost contact with the bottom end of the push-rod 51, and the valve member 49 is in sealing contact with the valve seat 47, thus positively shutting off the supply of air.

Closure of the safety valve 46 will obviously be assisted by the force of gravity acting on the push-rod 51 and valve member 47, if the tool is in the upright position as illustrated in FIGS. 1, 2A and 2B. However, it has been found that the force of air on the safety valve member 47 is sufficient to close the safety valve even when the tool is held upside down.

Figure 3:
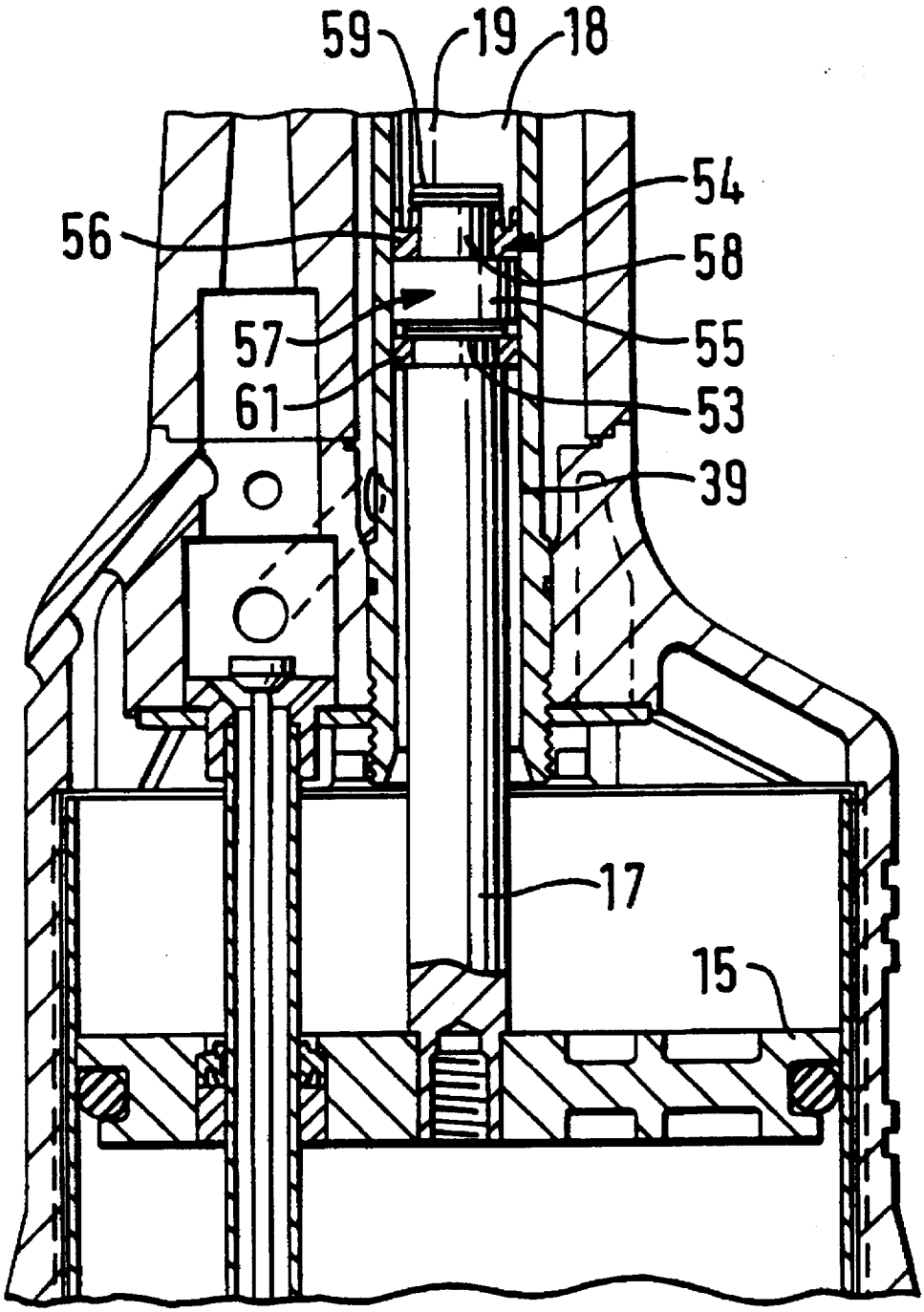
FIG. 3 is a longitudinal section through the hydraulic cylinder part of the tool showing the seal.

Referring now to FIG. 3, the upper end face 53 of the hydraulic piston rod supports a seal 54, which is not connected to the piston rod but is merely in contact with the end of the piston rod. In this example tool, the seal 54 comprises an assembly of two parts, a substantially rigid support member 55 of synthetic plastics material, and an annular flexible seal member 56, which makes sealing contact with the support member 55 and the wall of the cylinder 18. The support member 55 comprises a cylindrical base part 57, a projecting spigot part 58, and a radially outwardly projecting flange 59 at the free end of the spigot part 58 remote from the base part 57. The base part 57 of the support member has a diameter slightly smaller than that of the bore of the hydraulic cylinder 18, and has a flat underface which rests on, and can slide across, the flat upper face 53 of the piston rod 17. The annular flexible seal 56 surrounds the spigot part 58 and is retained on the support 55 by the flange 59. Just below its top face 53, the piston rod 17 is provided with guide means in the form of an annular ring 61 carried in an annular groove on the piston rod. The ring 61 is a sliding fit in the bore of the hydraulic cylinder 18 and is of synthetic plastics material, which is softer than the steel of the hydraulic cylinder 18 so that the guide ring does not scratch or score the cylinder wall.

The fact that the upper end face 53 of the piston rod 17 can slide sideways with respect to the under face of the seal support member 55 allows accommodation for some variation of alignment of the piston rod 17 with respect to the cylinder 18. Such misalignment, which may alter as the piston rod moves along the cylinder, may for example be caused by misalignment between the pneumatic cylinder liner 41 and the hydraulic cylinder 18. The ability to tolerate of such misalignment enables the construction and assembly of the tool to be reduced in cost.

Figure 4A:
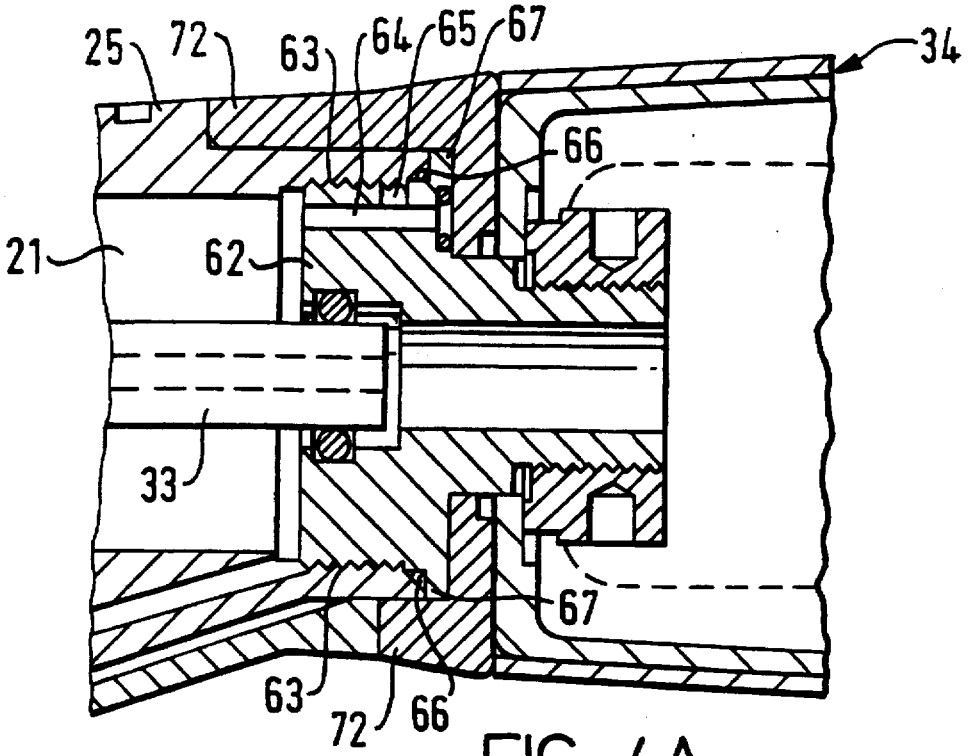
FIG. 4A and 4B are longitudinal sections through the rear part of the head cylinder of the tool, showing the operation of a safety device in relation to the rear end plug of the head cylinder.
Figure 4B:
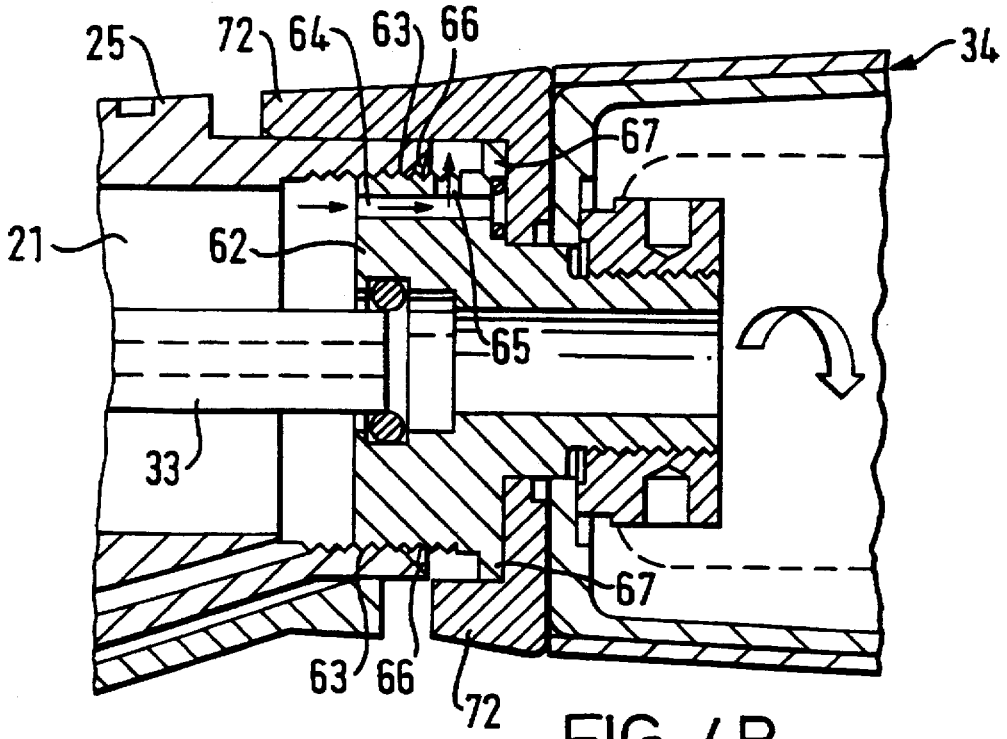

Referring now to FIGS. 4A and 4B, the rear end of the head cylinder 21 is closed by means of a plug 62 which is in screw-threaded engagement at 63 with the rear end of the head housing 25. FIG. 4A illustrates the plug screwed fully into the housing. Although the rear of the head cylinder, behind the hydraulic slave piston 22, contains only air at line supply pressure as previously described, the plug 62 provides the essential function of limiting the rearward travel of the piston 22 under the influence of the high pressure hydraulic fluid in the cylinder space in front of it. It is essential that the plug does not become completely unscrewed. The tool of this example provided with a safety device which, if the plug 62 becomes unscrewed and displaced beyond a predetermined amount, prevents further operation of the tool.

To this end, the plug 62 is provided with air vent means provided by bore 64 and orifice 65. The narrow bore 64 is parallel to the plug axis and near its outer peripheral edge. Part of the way along this bore is provided the transverse vent orifice 65 which connects the bore 64 with the outside circumferential surface of the plug 62. When the plug 62 is fully screwed home into the housing 25, the orifice 65 is inside the screw threaded portion 63, which is sealed from outside air by annular seal 66 between the rear end of the housing 25 and a flange 67 on the plug. If the plug 62 becomes unscrewed from the housing (or is insufficiently screwed in e.g. after removal for servicing of the tool) to such an extent that the orifice 65 is outside the annular seal 66 and communicates with the outside atmosphere (as illustrated in FIG. 4B), the air at line pressure in the rear of the head cylinder 21 is vented to atmosphere through the bore 64 and orifice 65.

Thus, after the next pulling stroke of the head piston, the air pressure behind it will be insufficient to return it, so that further operation of the tool is prevented. Additionally, the noise escaping of escaping air should alert the operator.

As an alternative form of construction, the air vent means could be provided in the head housing 25, being sealed by the plug 62 only when the latter is safely screwed into the housing.

Figure 5A:
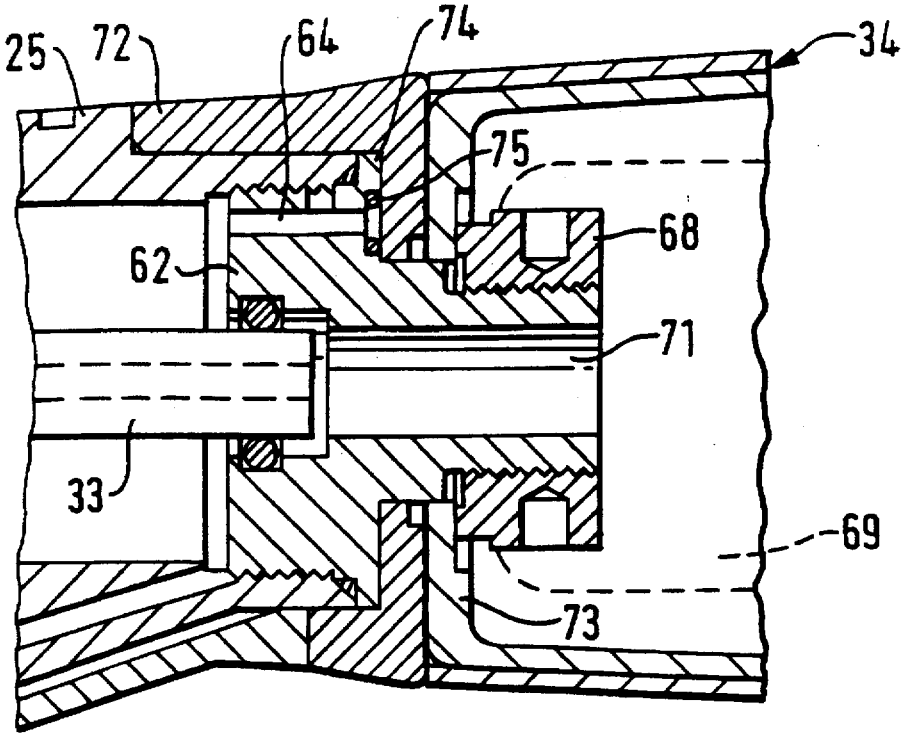
FIGS. 5A and 5B are similar to FIGS. 4A and 4B but show the operation of a safety device in relation to the stem collector.
Figure 5B:
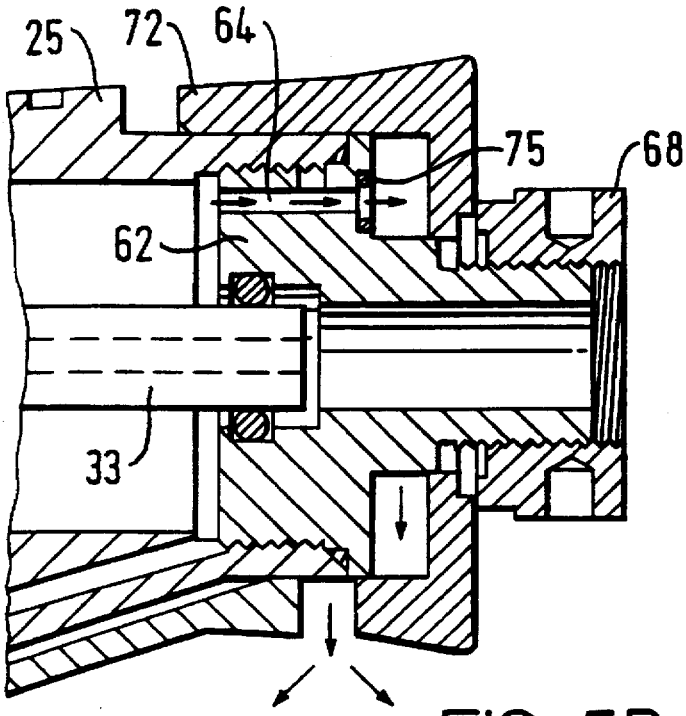

Referring now to FIGS. 5A and 5B, the stem collector 34 is secured to the rear end of the housing 25 by means of a locking ring 68 which screws onto the projecting rear end of the head cylinder rear end plug 62. The locking ring is inside the collector vessel 34, but access to the locking ring can be gained through a closable aperture 69 in the side of the collector. The aperture is provided for the prime purpose of removing collected broken-off rivet stems, and can be opened and closed by relative rotation of the inner and outer shells of the collector. It is essential that, when the tool is operated, the stem collector is mounted on the tool, since broken-off rivet stems are ejected at high speed through the central aperture 71 of the plug by the air ejection system previously mentioned.

Accordingly the tool of this example is provided with a safety device to prevent further operation of the tool if the collector 34 is not fitted to the tool. The head cylinder rear plug 62 is provided with air vent means in the form of a narrow bore 64, parallel to its axis and forming its inner and outer faces. Its outer end is normally sealed by a cover member 72 of synthetic plastics material which fits over the rear end of the housing 25 and around the projecting part of the end plug, between the other end annular face 74 of the plug 62 and the front end wall 73 of the collector 34. FIG. 5A illustrates that, when the collector is correctly fitted and held by the locking ring 68, the front end wall 73 of the collector holds the cover 72 into contact with the rear annular face 74 of the plug 62. An O-ring seal 75 around the rear end of the bore 64 ensures that the cover 72 seals the bore 64 against pressure air in the head cylinder 18, behind the head piston 17, escaping.

If, as illustrated in FIG. 5B, the collector is not fitted, the cover member 72 is not held in contact with the seal 75, so that the venting device provided by the bore 64 is open to atmosphere. Thus the air at line pressure behind the head piston 22 is vented, and the head piston is not returned forwards after its first pulling stroke. Consequently further operation of the tool is prevented. In addition, the noise of the escaping air should alert the operator to the fault condition. The venting safety device will operate in the same way if the cover member 72, or the locking ring 68, is not fitted, and if the locking ring 68 is not screwed up completely.

As an alternative form of construction, the small O-ring seal 75 surrounding the end of the orifice 64 (which could be easily lost on removing the collector 34) could be replaced by a large flat annular seal lying in an annular groove running completely around the annular rear face 74 of the plug 62, and overlying the outer end of the bore 64. If the cover 72 loses contact with the end face 74 of the plug 62, the air under pressure behind the seal escapes past the seal.

This type of safety device could also by used where the stem collection means includes a flexible hose to carry stems to a remote collector vessel. Correct attachment of the hose to the rear of the head housing would be checked in the same way.

The invention is not restricted to the details of the foregoing example. Alternative forms of construction of the example tool have been mentioned above, More broadly, for instance, the tool could be of the type in which the pulling head is separate from the pneumatic/hydraulic intensifier, the two units being connected to each other by hydraulic and pneumatic flexible hoses.

We claim:

1. A pneumatically powered fastener installation tool, including a pneumatic piston and cylinder device having an air supply conduit for supplying air under pressure to a cylinder on one side of the piston, which air supply conduit extends from an end of a cylinder on an other side of the piston and through the piston to said one side; an end of the cylinder on said one side being displaceable from a safe position in which the displaceable end of the cylinder is safely secured to the remainder of the cylinder;

and a safety device comprising:

valve means for disabling the supply of air to said one side of the piston;

and a push-rod operatively connected to the valve means and extending within the air supply conduit;

the push-rod contacting the displaceable end of the cylinder when the displaceable end is in the safe position so as to operate the valve means to allow the supply of air to the pneumatic chamber, and the push-rod being movable, when the displaceable end of the cylinder is displaced from the safe position, to operate the valve means so as to disable the supply of air under pressure to the cylinder on said one side of the piston.

2. A tool as claimed in claim 1, in which the displaceable end is secured in its safe position by securing means comprising a screw-threaded arrangement, in which the safety device is arranged to disable the supply of air as aforesaid when the engagement of the screw-threaded arrangement has been reduced to a predetermined number of screw-threads.

3. A tool as claimed in claim 1 in which the displaceable end is secured to the remainder of the chamber by securing means which is separate from the displaceable end.

4. A tool as claimed in claim 1, in which the valve means disables the supply of air to the cylinder by positively shutting off the supply of air.

5. A tool as claimed in claim 1, in which the valve means comprises a valve member cooperating with a valve seat, the valve member being operatively connected to the push-rod.

6. A tool as claimed in claim 5, in which the valve member is carried by the push-rod.

7. A tool as claimed in claim 1, in which the valve means is urged into the disabling position by the action of the air supply on it.

* * * * *